US006585878B2

(12) United States Patent
Strangman et al.

(10) Patent No.: US 6,585,878 B2
(45) Date of Patent: Jul. 1, 2003

(54) THERMAL BARRIER COATING HAVING A THIN, HIGH STRENGTH BOND COAT

(75) Inventors: Thomas E. Strangman, Phoenix, AZ (US); Derek Raybould, Denville, NJ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/214,678

(22) Filed: Aug. 7, 2002

(65) Prior Publication Data

US 2003/0017270 A1 Jan. 23, 2003

Related U.S. Application Data

(62) Division of application No. 09/542,610, filed on Apr. 4, 2000, now Pat. No. 6,485,844.

(51) Int. Cl.[7] ..... B05D 3/02; B05D 3/04; B05D 1/36; B05D 7/00; C25D 3/50

(52) U.S. Cl. ..... 205/264; 427/404; 427/405; 427/419.2; 427/376.1; 427/376.2; 427/376.6; 427/376.7; 427/376.8; 427/377; 427/383.3; 427/399

(58) Field of Search ..... 427/404, 405, 427/419.2, 376.1, 376.2, 376.6, 376.7, 376.8, 377, 383.3, 399, 255.26; 205/264

(56) References Cited

U.S. PATENT DOCUMENTS

| | | | | |
|---|---|---|---|---|
| 5,262,245 A | | 11/1993 | Ulion et al. | |
| 5,292,594 A | | 3/1994 | Liburdi et al. | |
| 5,645,893 A | | 7/1997 | Rickerby et al. | |
| 5,667,663 A | * | 9/1997 | Rickerby et al. | 205/170 |
| 5,716,720 A | | 2/1998 | Murphy | |
| 5,856,027 A | | 1/1999 | Murphy | |
| 6,410,153 B1 | * | 6/2002 | Broomfield et al. | 428/469 |

* cited by examiner

*Primary Examiner*—Michael Barr
(74) *Attorney, Agent, or Firm*—Robert Desmond, Esq.

(57) ABSTRACT

A thermal barrier coating for nickel based superalloy articles such as turbine engine vanes and blades that are exposed to high temperature gas is disclosed. The coating includes a columnar grained ceramic layer applied to a platinum modified $Ni_3Al$ gamma prime phase bond coat having a high purity alumina scale. The preferred composition of the bond coat is 5 to 16% by weight of aluminum, 5 to 25% by weight of platinum with the balance, at least 50% by weight, nickel. A method for making the bond coat is also disclosed.

26 Claims, 1 Drawing Sheet

THERMAL BARRIER COATING HAVING A THIN, HIGH STRENGTH BOND COAT

CROSS REFERENCE TO RELATED APPLICATION

This is a divisional application of U.S. application Ser. No. 09/542,610 filed Apr. 4, 2000 now U.S. Pat. No. 6,485,844.

TECHNICAL FIELD

This invention relates generally to thermal barrier coatings for superalloy substrates and to a method of applying such coatings.

BACKGROUND OF THE INVENTION

As gas turbine engine technology advances and engines are required to be more efficient, gas temperatures within the engines continue to rise. However, the ability to operate at these increasing temperatures is limited by the ability of the superalloy turbine blades and vanes to maintain their mechanical strength when exposed to the heat, oxidation, and corrosive effects of the impinging gas. One approach to this problem has been to apply a protective thermal barrier coating which insulates the blades and vanes and inhibits oxidation and hot gas corrosion.

Typically, thermal barrier coatings are applied to a superalloy substrate and include a bond coat overlayed by a ceramic top layer. The bond coat anchors both the top layer and itself to the substrate. The ceramic top layer is commonly zirconia stabilized with yttria and is applied either by the process of plasma spraying or by the process of electron beam physical vapor deposition (EB-PVD). Use of the EB-PVD process results in the outer ceramic layer having a columnar grained microstructure. Gaps between the individual columns allow the columnar grains to expand and contract without developing stresses that could cause spalling. Strangman, U.S. Pat. Nos. 4,321,311, 4,401,697, and 4,405,659 disclose thermal barrier coatings for superalloy substrates that contain a MCrAlY bond coat where M is selected from a group of cobalt, nickel, and iron. The MCrAlY bond coat is deposited by EB-PVD or vacuum plasma spaying. A more cost effective thermal barrier coating system is disclosed in Strangman, U.S. Pat. No. 5,514,482, which uses a diffusion aluminide bond coat. This bond coat is applied by electroplating platinum and diffusion aluminizing by pack cementation.

In commercially available thermal barrier coatings, the bond coat, whether MCrAlY or diffusion aluminide, is typically 1 to 5 mils thick and has a very low strength in comparison to the strength of the superalloy substrate. As a result, for design purposes the bond coats are considered to be non-load bearing.

At the high rotational speeds and temperatures typically encountered in today's gas turbine engines, these bond coats have a difficult time in supporting the weight of the thermal barrier coating. In at least one instance, the Applicants have observed evidence that bond coating creep deformation permitted the zirconia thermal barrier coating to creep off the tips of turbine blades during high speed and high temperature operation.

One proposed solution to this problem, is to deposit the ceramic layer directly onto the oxide scale on the substrate. The disadvantage to this approach is that it requires additional air cooling to reduce the superalloy substrate metal temperature in order to achieve a satisfactory oxidation life.

Accordingly, there is a need for a thin, high strength bond coat that minimizes coating weight without incurring a creep strength penalty while inhibiting substrate oxidation.

SUMMARY OF THE INVENTION

An object of the present invention is to provide a superalloy article having a thin, high strength bond coat.

Another object of the present invention is to provide a thermal barrier coating system having a thin, high strength bond coat.

Yet another object of the present invention is to provide a method for applying such a bond coat.

The present invention achieves these objects by providing a thermal barrier coating for nickel based superalloy articles such as turbine engine vanes and blades that are exposed to high temperature gas. The coating includes a columnar grained ceramic layer applied to a platinum modified $Ni_3Al$ gamma prime phase bond coat having a high purity alumina scale. The preferred composition of the bond coat is 5 to 16% by weight of aluminum, 5 to 25% by weight of platinum with the balance, at least 50% by weight, nickel. The preferred thickness of the bond coating is 10 to 30 microns. A method for making the bond coat is also disclosed.

DESCRIPTION OF THE PREFERRED EMBODIMENT

Figure 1:
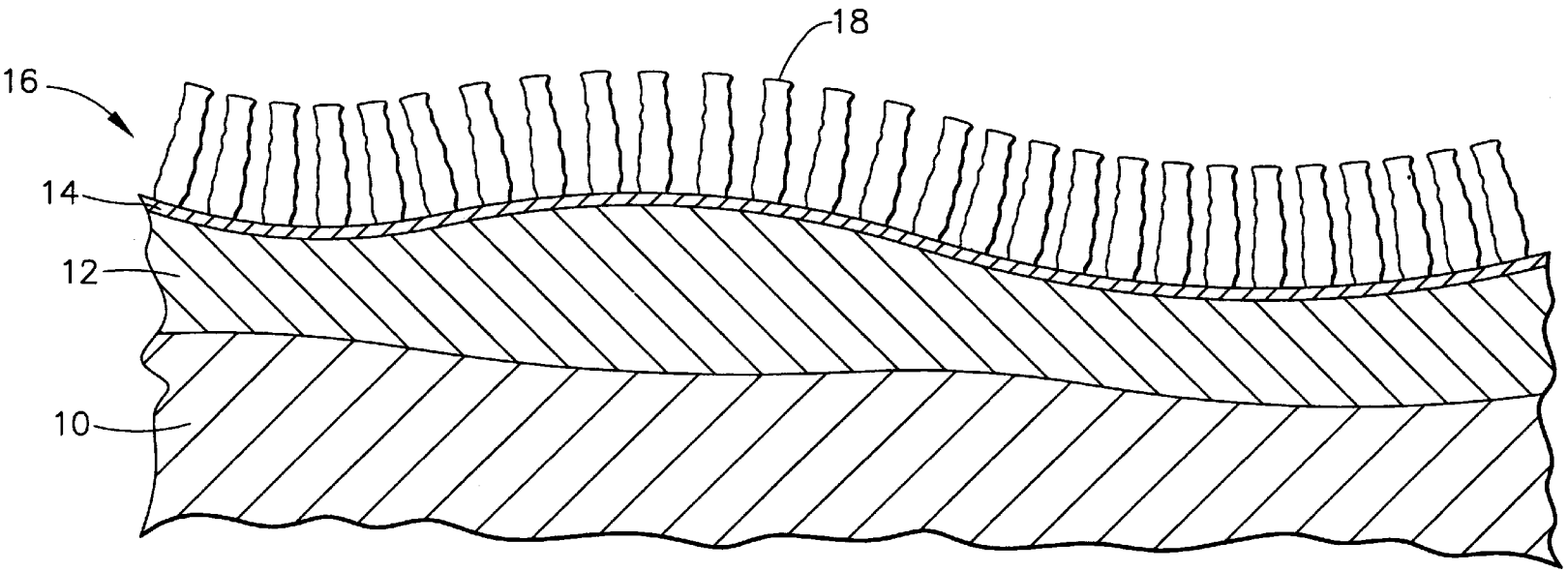
FIG. 1 is a cross sectional schematic of a coated article having a thermal barrier coating as contemplated by the present invention.

Referring to FIG. 1, a base metal or substrate 10 is a nickel based high temperature alloy from which turbine airfoils are commonly made. Preferably, the substrate 10 is a nickel based superalloy such as MAR-M247 or SC180, the compositions of which is shown in Table 1.

TABLE 1

| Alloy | Mo | W | Ta | Re | Al | Ti | Cr | Co | Hf | Zr | C | B | Ni |
|---|---|---|---|---|---|---|---|---|---|---|---|---|---|
| Mar-M247 | .65 | 10 | 3.3 | — | 5.5 | 1.05 | 8.4 | 10 | 1.4 | .05 | 0.15 | .015 | bal. |
| SC180 | 1.7 | — | 8.5 | 3.0 | 5.2 | 1.0 | 5.3 | 10 | — | — | 0.1 | — | bal. |

A bond coat 12 lies over a portion of the substrate 10. The bond coat 12 is formed by electroplating a thin layer of platinum onto a cleaned surface of the substrate 10. The term "thin" as used herein means a thickness when applied in the range of 0.4 to 1.2 microns, with 0.5 microns preferred. In the preferred embodiment the coated substrate is then heat treated in a vacuum and at a temperature in the range of 1000 to 1200° C. During the heat treatment, the platinum diffuses into the substrate to form a platinum enriched substrate surface that retains the substrate's crystallographic texture.

This heat treatment step is optional, as diffusion of the platinum into the substrate will also occur during subsequent heat treatment steps described later in the specification.

The next step in forming the bond coat 12 is to deposit on the platinum enriched substrate, a layer of high purity aluminum using for example the method described in U.S. Pat. No. 5,292,594 which is incorporated herein by reference to the extent necessary to understand the present invention. To achieve the high purity, the aluminum is deposited from a pure source of aluminum by a chemical reaction with a gas which further refines the aluminum as the reactor conditions are adjusted so the gas reacts primarily with aluminum as it is deposited over the platinum coated substrate. Impurities from the substrate alloy or the reactor environment that are readily picked up and deposited by techniques such as over the pack or in the pack are avoided. In particular, impurities such as sulphur and phosphorous which are well known to promote spalling of thermally grown oxide scales, are reduced to levels which are negligible and nearly non detectable. The thickness of this aluminum layer is in the range of 2 to 12 microns as applied.

Because even trace impurities are avoided in depositing the high purity aluminum, a high purity aluminum oxide scale 14 having a metastable non-alpha crystal structure is grown during a vacuum or hydrogen heat treatment at a temperature in the range of 600 to 1000° C. A small partial pressure of oxygen or water vapor should be present during the thermal cycle of the heat treatment to enable thermal growth of the high purity aluminum oxide scale 14. During this heat treatment, the underlying platinum layer temporarily inhibits diffusion of other elements from superalloy substrate to surface allowing the alumina scale 14 to become continuous. That is there are substantially no holes or breaks in the alumina scale 14 and substantially no other metal oxides are formed. The formation of metal oxides that allow the diffusion of oxygen through them would reduce the effectiveness of the alumina scale 14 as an oxidation barrier. Because conventional deposition processes such as over the pack allow the formation of other oxides, they do not exploit the full potential of the alumina scale as an oxygen barrier.

The high purity alumina scale 14 is then converted to a stable alpha phase during a heat treatment at a temperature in the range of 950 to 1200° C. During this heat treatment sufficient amounts of nickel diffuse from the substrate 10 into the bond coat 12 so that the bond coat 12 becomes predominately a platinum modified $Ni_3Al$ (gamma prime) phase, having the same crystallographic texture as the substrate. This bond coat 12 is also alloyed with the other elements present in the superalloy substrate 10, some of which may be present in the platinum modified gamma prime $Ni_3Al$, essentially forming $Ni_3$(Al, Pt, M), where M is a conventional gamma prime modifiers known to those skilled in art such as Ti, Ta, Nb, Hf. Different superalloys have different percent M, see for example Table 1, therefore the percent of platinum required to modify the $Ni_3$(Al, Pt, M) will vary with the superalloy and the diffusivity, at the heat treatment temperature, of M into the bond coat. In the preferred embodiment, the composition of the bond coat 12 is 5 to 16% by weight of aluminum, 5 to 25% by weight of platinum with the balance containing at least 50% nickel by weight. Other elements present in the superalloy substrate 10 may also be present in the bond coat 12, but are not necessary to the practice of the present invention. The preferred thickness range for the fully heat treated bond coating is 10 to 30 microns.

The ceramic coat 16 may be any of the conventional ceramic compositions used for this purpose. A preferred composition is yttria stabilized zirconia. Alternatively, the zirconia may be stabilized with CaO, MgO, $CeO_2$ as well as $Y_2O_3$. Another ceramic believed to be useful as the columnar type coating material within the scope of the present invention is hafnia, which can be yttria-stabilized. The particular ceramic material selected should be stable in the high temperature environment of a gas turbine. The thickness of the ceramic layer may vary from 1 to 1000 microns but is typically in the 50 to 300 microns range. The ceramic coat 16 is applied by EB-PVD and as result has a columnar grained microstructure with columnar grains or columns 18 oriented substantially perpendicular to the surface of the substrate 10 and extending outward from the bond coat 12 and alumina scale 14.

EXAMPLE

A 0.5 micron thick layer of platinum was electrolytically deposited on a single crystal superalloy SC180 specimen, the composition of which is given in Table 1. This specimen was heat treated in vacuum at 1,000° C. A high purity aluminum coat was then deposited onto the platinum to a thickness of 10 microns. This specimen was heat treated at 1200° C. for 2 hours. A conventional 8% yttria stabilized zirconia thermal barrier coating was then deposited onto the specimen by a commercially available EB-PVD process.

The total thickness of the resulting bond coat including a diffusion zone was less than 20 microns. In addition, detrimental voids typically high in sulphur and phosphorous found in prior art bond coats were not observed due to the use of high purity coatings and coating techniques. The bond coat was confirmed by X-ray analysis to have a $Ni_3Al$ type structure.

The specimen with the thin, strong bond coat of the present invention was tested by subjecting it to cyclic oxidation between 1150° C. and room temperature. The thermal barrier coating on this specimen had twice the spalling life relative to an identical thermal barrier coating applied to a commercially available, prior art platinum-aluminide bond coat also on a SC180 specimen.

Various modifications and alterations to the above-described preferred embodiment will be apparent to those skilled in the art. Accordingly, this description of the invention should be considered exemplary and not as limiting the scope and spirit of the invention as set forth in the following claims.

What is claimed is:

1. A method of applying a thermal barrier coating to a nickel based superalloy substrate comprising the steps of:

a) applying a layer of platinum to a surface of said substrate;

b) applying a layer of aluminum onto said platinum layer;

c) growing an aluminum oxide scale layer from said aluminum layer;

d) converting said aluminum oxide scale layer to a crystallographically stable alpha phase during heat treatment that diffuses nickel from said substrate to form a platinum modified $Ni_3Al$ gamma prime phase bond coat; and e) applying a ceramic coat over said bond coat.

2. The method of claim 1 wherein step (c) includes heat treating with a partial pressure of oxygen or water.

3. The method of claim 2 wherein step (c) further includes inhibiting a diffusion of elements from said substrate until the aluminum oxide scale becomes continuous.

4. The method of claim 3 wherein said heat treating occurs at a temperature in the range of 600 to 1000° C.

5. The method of claim 1 wherein step (d) includes heat treating at a temperature in the range of 950 to 1200° C.

6. The method of claim 1 wherein step (a) includes electroplating said platinum onto said surface.

7. The method of claim 1 wherein said platinum layer has a thickness in the range of 0.4 to 1.2 microns as applied.

8. The method of claim 1 further including between steps (a) and (b) a step of heat treating at a temperature in the range of 1000 to 1200° C.

9. The method of claim 1 wherein a thickness of said aluminum layer is in the range of 2 to 12 microns as applied.

10. The method of claim 1 Wherein after step (d) a composition of said bond coat is 5 to 16% by weight of aluminum, 5 to 25% by weight of platinum with the balance, at least 50% by weight, nickel.

11. The method of claim 2 wherein said heat treating in step (c) is in a vacuum.

12. The method of claim 2 wherein said heat treating in step (c) is in a hydrogen atmosphere.

13. A method of applying a thermal barrier coating to a nickel based superalloy substrate, comprising:

a) applying a layer of platinum having a maximum thickness of 1.2 microns as applied to a surface of said substrate;

b) applying a layer of aluminum onto said platinum layer;

c) growing an aluminum oxide scale layer from said aluminum layer;

d) converting said aluminum oxide scale layer to a crystallographically stable alpha phase during heat treatment that diffuses nickel from said substrate to form a platinum modified $Ni_3Al$ gamma prime phase bond coat; and e) applying a ceramic coat over said bond coat.

14. The method of claim 13 wherein step (c) includes heat treating with a partial pressure of oxygen or water.

15. The method of claim 14 wherein step (c) further includes inhibiting a diffusion of elements from said substrate until the aluminum oxide scale becomes continuous.

16. The method of claim 13 further including between steps (a) and (b) a step of heat treating at a temperature in the range of 1000 to 1200° C.

17. The method of claim 13 wherein the thickness of said aluminum layer is at least 2 microns as applied.

18. The method of claim 14 wherein said heat treating in step (c) is in one of a vacuum and a hydrogen atmosphere.

19. A method of applying a thermal barrier coating to a nickel based superalloy substrate, comprising:

a) applying a layer of platinum to a surface of said substrate;

b) applying a layer of aluminum onto said platinum layer;

c) heat treating said coating to grow a continuous aluminum oxide scale having a metastable non-alpha crystal structure from said aluminum layer;

d) diffusing said platinum and aluminum into said substrate to form a platinum modified $Ni_3Al$ gamma prime phase bond coat that has a crystallographic texture of said substrate;

e) heat treating said substrate to convert the said metastable aluminum oxide scale to a crystallographically stable alpha phase; and f) applying a ceramic coat over said bond coat.

20. The method of claim 19, wherein step (a) further comprises limiting a maximum thickness of said platinum layer to 1.2 microns.

21. The method of claim 19, wherein step (e) occurs at a temperature of 950 to 1200° C.

22. The method of claim 19, further comprising limiting a maximum thickness of said aluminum layer to 12 microns.

23. The method of claim 19, wherein step (c) occurs at a temperature of 600 to 1000° C.

24. The method of claim 19, wherein step (c) further comprises inhibiting diffusion of elements from said substrate.

25. The method of claim 19, wherein step (c) further comprises minimizing an existence at holes and breaks in said aluminum oxide scale by inhibiting diffusion of elements from said substrate at a temperature of 600 to 1000° C.

26. The method of claim 19, wherein step (d) occurs at a temperature in the range of 950 to 1200° C.

* * * * *